United States Patent [19]

Hattiangadi

[11] 4,355,601

[45] Oct. 26, 1982

[54] RECIRCULATING FLUE GAS FLUIDIZED BED HEATER

[75] Inventor: Uday S. Hattiangadi, Ponca City, Okla.

[73] Assignee: Conoco Inc., Ponca City, Okla.

[21] Appl. No.: 305,755

[22] Filed: Sep. 25, 1981

[51] Int. Cl.[3] ..... F22B 1/02

[52] U.S. Cl. ..... 122/4 D; 122/7 R; 110/245; 110/205; 110/204

[58] Field of Search ..... 122/4 D, 7 R, 20 B; 110/245, 204, 205, 234

[56] References Cited

U.S. PATENT DOCUMENTS

| | | | |
|---|---|---|---|
| 1,628,609 | 5/1927 | Newhouse | 110/205 |
| 1,729,763 | 10/1929 | DeFlorez | 110/205 |
| 1,857,364 | 5/1932 | Rachat . | |
| 3,589,313 | 6/1971 | Smith et al. . | |
| 3,769,922 | 11/1973 | Furlong et al. . | |
| 3,776,151 | 12/1973 | Wilson | 110/204 |
| 3,848,549 | 11/1974 | Pryor et al. . | |
| 3,884,193 | 5/1975 | Bryers | 122/4 D |
| 3,921,544 | 11/1975 | Reese . | |
| 3,941,065 | 3/1976 | Albrecht . | |
| 4,021,184 | 5/1977 | Priestley . | |
| 4,084,545 | 4/1978 | Nack et al. | 110/245 |
| 4,183,306 | 1/1980 | Haga et al. . | |
| 4,196,676 | 4/1980 | Brown et al. | 110/245 |
| 4,240,377 | 12/1980 | Johnson . | |
| 4,286,548 | 9/1981 | Brash | 110/204 |
| 4,291,649 | 9/1981 | Boder | 122/20 B |

*Primary Examiner*—Henry C. Yuen

*Attorney, Agent, or Firm*—A. Joe Reinert

[57] ABSTRACT

A fluidized bed boiler system and a manner of operating the same is provided wherein a fluidized particulate bed in which solids are not recycled is utilized. High temperature flue gas is directed to a boiler means. A portion of both the high temperature and a low temperature gas stream are recycled to a fluidizing gas stream for fluidizing the particulate bed.

20 Claims, 1 Drawing Figure

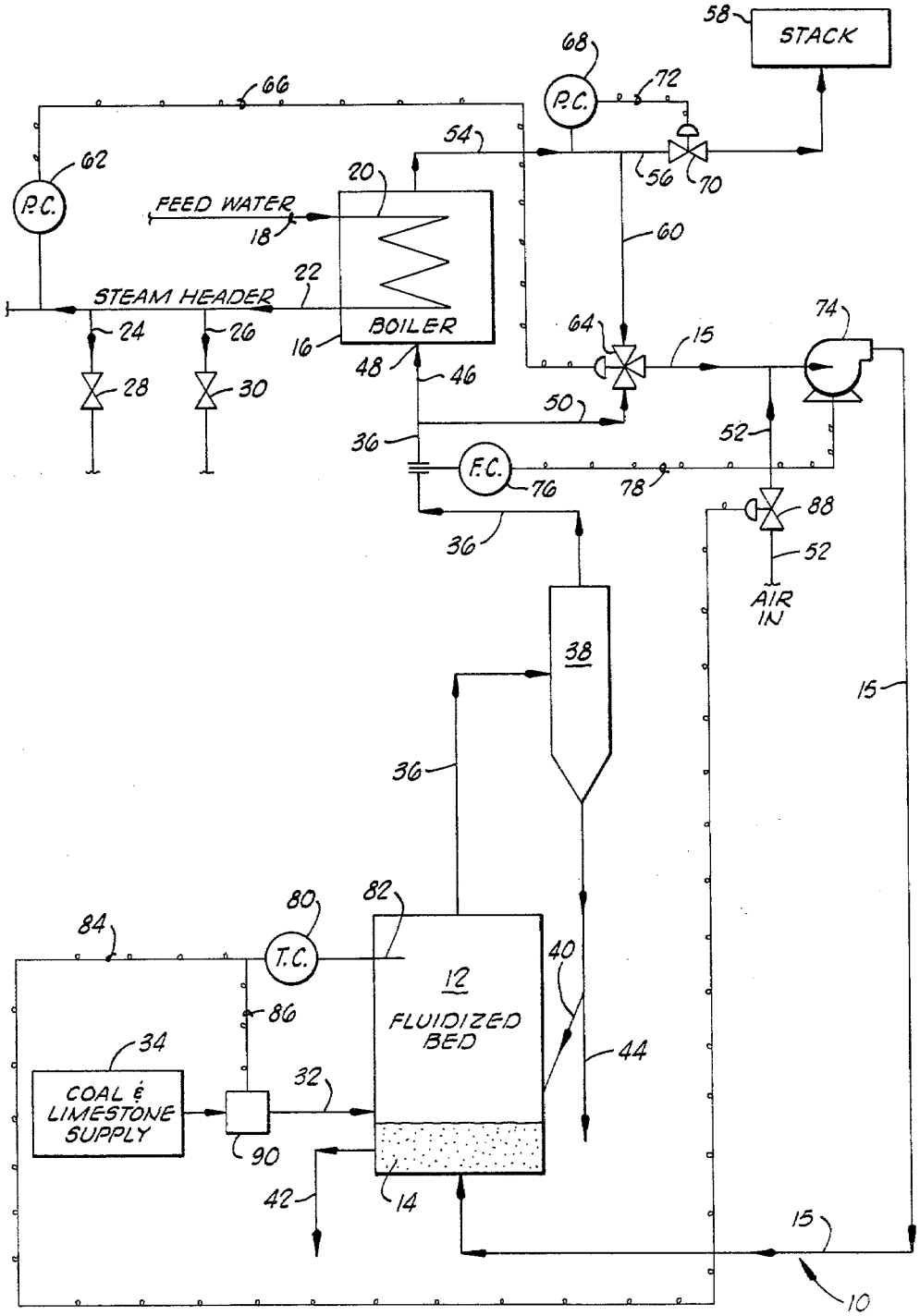
STACK
P.C.
FEED WATER
STEAM HEADER
BOILER
F.C.
T.C.
AIR IN
FLUIDIZED BED
COAL & LIMESTONE SUPPLY

RECIRCULATING FLUE GAS FLUIDIZED BED HEATER

BACKGROUND OF THE INVENTION

1. Field of the Invention

The present invention relates generally to fluidized bed heater systems wherein both high temperature and low temperature flue gas are recirculated to the fluidized bed as a fluidizing gas.

2. Description of the Prior Art

In conventional fluidized bed boilers, coal combustion takes place within a bed of limestone fluidized with air. Tubes submerged directly in the fluidized bed recover the heat of combustion by intimate contact with the hot solids. Additional heat is recovered from the hot flue gases in a convection section above the fluidized bed.

A fairly recent modification of conventional fluidized bed boilers is the solids circulation fluidized bed wherein the fluidized particulate bed itself is recycled to control and maintain fluidized bed temperature. An example of the solids recirculation fluidized bed boiler is shown in U.S. Pat. No. 4,240,377 to Johnson.

Significant problems have been encountered with both the conventional fluidized bed boilers and the more recent solids recirculation fluidized bed boilers.

With the conventional fluidized bed boilers, problems are presented by the heat transfer tubes present in the fluidized bed. These problems include corrosion problems with the heat transfer surface and problems associated with the maldistribution of gas in the fluidized bed. Also, conventional fluidized bed systems have encountered problems in turn down, i.e., problems when the load demand on the boiler is reduced or increased.

The solids recirculation fluidized bed systems have particularly encountered problems due to erosion caused by the circulating solids.

SUMMARY OF THE INVENTION

The present invention provides an improved fluidized bed boiler system wherein a fluidized bed in which the solids are not recycled is utilized and wherein flue gas is recycled to provide the fluidizing gas for the fluidized bed so as to maintain the fluidized bed temperature at a constant level. More particularly, the system includes a fluidized particulate bed and first conduit means for injecting a stream of fluidizing gas into the fluidized particulate bed. Charge means are provided for charging fuel into the fluidized particulate bed. A second conduit means extracts a high temperature flue gas stream from the fluidized particulate bed. A third conduit means directs a first portion of the high temperature flue gas stream to a boiler means for transferring heat energy from the high temperature flue gas stream to feed water to generate steam from the feed water. The steam is directed to a steam header. A fourth conduit means recycles a second portion of the high temperature flue gas stream from the second conduit means to the fluidizing gas stream in the first conduit means. Fifth conduit means introduces a stream of combustion gas (preferably air) to the fluidizing gas stream in the first conduit means. Sixth conduit means extracts a low temperature flue gas stream from the boiler means. A seventh conduit means directs a first portion of the low temperature flue gas stream from the sixth conduit means to an exhaust stack and an eighth conduit means recycles a second portion of the low temperature flue gas stream to the fluidizing gas stream in the first conduit means.

Means are provided for sensing a variation in demand for steam at the steam header and for controlling the relative amounts of the high and low temperature flue gas streams which are recycled to the fluidizing gas stream, in response to the sensed load at the steam header.

Temperature sensing means are provided for sensing the variation in temperature of the high temperature flue gas stream, and control means are provided for varying the rate at which fuel and air are charged to the system so as to maintain substantially constant the temperature of the high temperature flue gas stream.

Pressure sensing means is provided for sensing the pressure of the low temperature flue gas stream in the sixth conduit means and control means are disposed in the seventh conduit means for controlling the first portion of the low temperature flue gas stream directed to the stack and for thereby regulating a flue gas pressure in the boiler means.

A flow sensing means is provided in the second conduit means for sensing a flow rate of the high temperature flue gas stream, and variable speed blower means are provided between the fifth and the first conduit means for varying a flow rate of the fluidizing gas stream in response to the sensed flow rate of the high temperature flue gas stream and for thereby maintaining the flow rate of the high temperature flue gas stream substantially constant. Accordingly, the flow rate of fluidizing gas through the fluidized particulate bed is maintained substantially constant over the whole range of boiler loads. A constant bed expansion is thus maintained. Unit turn down, which is a problem with conventional fluidized bed technology, is not a problem with the present invention since the operation of the fluidized bed is unaffected by turn down of the boiler.

It is, therefore, a general object of the present invention to provide an improved fluidized bed heating system and method of operating the same.

Another object of the present invention is the provision of a fluidized bed heater system wherein both high temperature and low temperature flue gases are recycled to the fluidizing gas stream, and the provision of methods of operating such a system.

Yet another object of the present invention is the provision of a fluidized bed heater system utilizing a fixed fluidized bed wherein the temperature of high temperature flue gas exiting the bed and the flow rate of fluidizing gas through the bed are maintained substantially constant regardless of boiler load, and the provision of methods of operating such a system.

Still another object of the present invention is the provision of a fluidized bed heater system wherein a maximum amount of flue gas is recycled to the fluidizing gas stream thus conserving energy within the system and minimizing losses of energy due to the loss of flue gas up the stack, and the provision of methods of operating such a system.

Other and further objects, features and advantages of the present invention will be readily apparent to those skilled in the art upon a reading of the following disclosure when taken in conjunction with the accompany drawing.

BRIEF DESCRIPTION OF THE DRAWING

The FIGURE is a schematic flow diagram of the fluidized bed boiler system of the present invention.

DETAILED DESCRIPTION OF THE PREFERRED EMBODIMENTS

Referring now to the drawing, the fluidized bed boiler system of the present invention is shown and generally designated by the numeral 10. The system 10 includes a fluidized bed 12 of particulate material 14.

A first conduit means 15 is connected to the fluidized particulate bed 14 for injecting a stream of fluidizing gas into the fluidized particulate bed 12 to fluidize the particulate material 14 contained therein.

A boiler means 16, which may generally be referred to as a heat exchanger means, is provided for transferring heat energy from a high temperature flue gas stream to feed water to generate steam from the feed water.

Feed water is directed to the boiler 16 by feed water conduit 18 connected to heat exchange tubes 20 within the boiler means 16.

A steam header 22 is connected to the heat exchange tubes 20 for receiving steam therefrom. The steam header 22 is indicated as having two take-off lines 24 and 26 connected thereto which have valve means 28 and 30 connected thereto, respectively. The take-off lines 24 and 26 are intended to schematically illustrate in a general form a point of use of the steam from steam header 22.

For example, the take-off lines 24 and 26 can be connected to an inlet of a steam turbine wherein the heat energy within the steam is converted to electrical energy or some other more usable form of energy. Also, the steam can be directed to a steam injection well or the like where the heat energy from the steam is used directly.

As used in the present disclosure, the term "steam header" refers generally to any conduit means connecting the outlet of the heat transfer tubes 20 from boiler 16 to a point of use of the steam.

A charge means 32 is provided for charging fuel from a source 34 to the fluidized particulate bed 12. Preferably, the fuel is comprised of relatively small particles of coal. Mixed with the fuel is limestone or other suitable material for reacting with sulfur in the coal to prevent the emission of sulfur dioxide in the flue gas.

A second conduit means 36 is communicated with the fluidized particulate bed 12 for extracting a high temperature flue gas stream from the fluidized particulate bed 12.

Disposed in the second conduit means 36 is a cyclone separator 38 for removing entrained particulate materials such as coal ash and the like from the high temperature flue gas stream in a manner generally known to those skilled in the art. The particulate material removed from the high temperature flue gas stream by cyclone separator 38 is returned to the fluidized particulate bed by a recycle conduit 40.

Spent limestone and ash may be withdrawn from the fluidized particulate bed 12 either directly as indicated by the conduit 42, or by withdrawing the same from the recycle line 40 as indicated by conduit 44.

A third conduit means 46 is connected between second conduit means 36 and a shell side inlet 48 of boiler means 16 for directing a first portion of the high temperature flue gas stream from the second conduit means 36 to the boiler means 16.

A fourth conduit means 50 is connected between second conduit means 36 and first conduit means 15 for recycling a second portion of said high temperature flue gas stream from the second conduit means 36 to the first conduit means 15 and thus to the fluidized particulate bed 12. Fourth conduit means 50 is connected directly between the second conduit means 36 and the first conduit means 15 such that the second portion of the high temperature flue gas stream is conducted directly to the fluidizing gas stream without any substantial heat transfer from the second portion of the high temperature flue gas stream other than the mixing of the second portion of the high temperature flue gas stream with the second portion of the low temperature flue gas stream and the combustion gas stream.

A fifth conduit means 52 is connected to first conduit means 15 for introducing a stream of combustion supporting gas containing oxygen, preferably air, to said first conduit means 15. The terms combustion air and combustion gas are used interchangeably in this disclosure, but it will be understood that the more general term "combustion gas" includes air or any other combustion supporting gas containing oxygen.

A sixth conduit means 54 is connected to boiler means 16 for extracting a low temperature flue gas stream from boiler means 16.

A seventh conduit means 56 is connected between sixth conduit means 54 and an exhaust stack 58 for directing a first portion of said low temperature flue gas stream from said sixth conduit means 54 to the exhaust stack 58.

An eighth conduit means 60 is connected between sixth conduit means 54 and first conduit means 15 for recycling a second portion of said low temperature flue gas stream from the sixth conduit means 54 to the fluidizing gas stream in first conduit means 15 and thus to the fluidized particulate bed 12.

A pressure sensing means 62 is communicated with the steam header 22 for sensing a variation in demand for steam at the steam header 22. For example, if the valve 28 is opened beyond an initial setting, the rate at which steam is withdrawn through take-off line 24 will increase thus decreasing the pressure within steam header 22. The pressure sensing means 62 may also be referred to as a means for sensing a variation in load on the boiler 16. The load on the boiler 16 is the demand for energy to be taken from the flue gas flowing therethrough. Thus, if the load on boiler means 16 increases there is a need to increase the amount of high temperature flue gas passing therethrough in order to provide the necessary energy to meet the load demand.

A three-way control valve 64 is connected to first conduit means 15, fourth conduit means 50, and eighth conduit means 60. Control valve 64 is connected to pressure sensing means 62 by a control line 66 so that the control valve 64 is operated in response to the pressure sensed by pressure sensing means 62. The control valve 64 varies the second portion of the high temperature flue gas stream flowing through fourth conduit 50 to the first conduit means 15 relative to the first portion of the high temperature flue gas stream flowing through third conduit means 48. Control valve means 64 may also vary the second portion of the low temperature flue gas stream flowing through fourth conduit means 60 relative to the first portion of the low temperature flue gas stream flowing through seventh conduit means 56.

Thus, if the pressure sensing means 62 senses an increase in pressure within steam header 22, denoting a decrease in load on the boiler means 16, the control valve means 64 increases the second portion of the high temperature flue gas stream relative to the first portion of the high temperature flue gas stream so that the rate of high temperature flue gas flowing through boiler means 16 is decreased. Also, the rate at which the second portion of the low temperature flue gas stream flows through eighth conduit means 60 is decreased because the rate of the extraction of low temperature flue gas from the boiler means 16 decreases when the rate of high temperature flue gas directed to the boiler means 16 decreases.

A second pressure sensing means 68 is communicated with sixth conduit means 54 for sensing a pressure of the low temperature flue gas stream in sixth conduit means 54.

A control valve means 70 is disposed in seventh conduit means 56 and is connected to pressure sensing means 68 by a control line 72. The control valve means 70 is used to control the flue gas pressure in boiler means 16 by varying a restriction through which the first stream of low temperature flue gas must pass so as to vary the rate at which the first stream of low temperature flue gas exits to the flue gas stack 58.

A variable speed blower means 74 is disposed in first conduit means 15. Blower means 74 is utilized to force the fluidizing gas stream through first conduit means 15 to the fluidized particulate bed 12. A flow sensing means 76 is connected to second conduit means 36 for sensing a flow rate of the high temperature flue gas stream in second conduit means 36. The flow sensing means 76 is connected to variable speed blower 74 by a flow control line 78 so that the speed of blower 74 is varied in response to the flow rate sensed by flow rate sensing means 76.

The speed of variable speed blower 74 is varied so as to maintain the flow rate of the high temperature flue gas stream in second conduit means 36 substantially constant. For example, if sensor 76 senses that the high temperature flue gas stream is dropping to a flow rate below the predetermined constant level, a signal is sent through control line 78 to variable speed blower means 74 to increase the speed of blower means 74 and increase the rate at which the fluidizing gas stream flows through first conduit means 15 to the fluidized particulate bed 12.

A temperature sensing means 80 is provided for sensing the temperature of the high temperature flue gas stream and for sensing any variations in said temperature. As indicated in the FIGURE, the temperature sensing means 80 includes a thermowell 82 inserted in the fluidized particulate bed near the upper end thereof where the high temperature flue gas stream exits the particulate bed.

The temperature sensor 80 is connected by control lines 84 and 86 to a combustion air control valve 88, and a fuel charge rate control means 90, respectively. The control means 88 and 90 are operatively associated with the temperature sensing means 80 such that if the temperature sensing means 80 senses an increase in temperature within the fluidized particulate bed 12 above a predetermined desired temperature, the charge rate of fuel and the rate at which combustion air are added to the fluidized particulate bed 12 are decreased to as to bring the temperature of the high temperature flue gas stream back to the predetermined substantially constant level.

A fast response to boiler load change is provided by the fact that in response to a sensed load change the system 10 merely varies the rate at which high temperature flue gas is directed to the boiler 16 and correspondingly the rate at which high temperature flue gas is recycled, and the additional heat necessary for an increase in load or the excess heat provided due to a decrease in load is either extracted from or added to, respectively, the fluidized particulate bed 12 itself which acts as a large heat sink. The temperature within the fluidized bed 12 is then controlled by varying the combustion rate therein by varying the rate at which coal and combustion air are charged to the fluidized particulate bed.

Manner of Operation and Examples

The following Table I gives example flow rates and temperatures of the various streams of the system 10 at 0%, 50% and 100% of maximum boiler load. Several simplifying assumptions have been made to calculate the flow rates of Table I.

It is assumed that coal is 100% carbon with a BTU content of 14,0900 BTU/pound.

A second assumption is that no excess air is used. In actual practice excess air in the range of approximately 10–20% should be provided.

A third assumption is that the specific heat of air and flue gas is 0.24 BTU/pound°F. at all temperatures.

A fourth assumption is that the low temperature flue gas stream is at 400° F. for all boiler loads.

TABLE I

| | | 0% Load | | 50% Load | | 100% Load | |
|---|---|---|---|---|---|---|---|
| Conduit | Stream | Rate (lb/hr) | Temp. (°F.) | Rate (lb/hr) | Temp (°F.) | Rate (lb/hr) | Temp (°F.) |
| 15 | Fluidizing Gas | 588,000 | 1500 | 582,000 | 914 | 576,000 | 315 |
| 36 | Hi-Temp Flue Gas | 588,000 | 1500 | 588,000 | 1500 | 588,000 | 1500 |
| 46 | Hi-Temp to Boiler | 0 | 1500 | 294,000 | 1500 | 588,000 | 1500 |
| 50 | Hi-Temp Recycle | 588,000 | 1500 | 294,000 | 1500 | 0 | 1500 |
| 52 | Combustion Air | 0 | 60 | 72,000 | 60 | 144,000 | 60 |
| 54 | Low-Temp Flue Gas | 0 | 400 | 294,000 | 400 | 588,000 | 400 |
| 56 | Low-Temp to Stack | 0 | 400 | 78,000 | 400 | 156,000 | 400 |
| 60 | Low Temp Recycle | 0 | 400 | 216,000 | 400 | 432,000 | 400 |
| 32 | Coal | | | | | | |

TABLE I-continued

| | | 0% Load | | 50% Load | | 100% Load | |
|---|---|---|---|---|---|---|---|
| Conduit | Stream | Rate (lb/hr) | Temp. (°F.) | Rate (lb/hr) | Temp (°F.) | Rate (lb/hr) | Temp (°F.) |
| | Charge | 0 | 60 | 6,000 | 60 | 12,000 | 60 |

The data of Table I may be more clearly understood from the following description of the system 10 at 50% boiler load.

When operating the boiler means 16 at 50% of maximum load, fluidizing gas is injected into fluidized particulate bed 12 by first conduit means 15 at a flow rate of 582,000 lb/hour and at a temperature of 914° F. to fluidize the particulate bed.

Coal is charged into the fluidized particulate bed through conduit 32 at a rate of 6,000 lb/hour and a temperature of 60° F.

The coal is then burned in the fluidized particulate bed 12 and a high temperature flue gas stream is extracted from the fluidized particulate bed 12 by second conduit means 36 at a rate of 588,000 lb/hour and a temperature of 1500° F. As shown in Table 1, the system of the present invention is operated in such a manner that the flow rate and temperature of the high temperature flue gas stream is maintained substantially constant regardless of the boiler load.

Third conduit means 46 directs a first portion of the high temperature flue gas stream to the boiler means 16 at a rate of 294,000 lb/hour and a temperature of 1500° F. For a temperature drop from 1500° F. to 400° F. through the particular boiler means 16, this flow rate is calculated to provide sufficient energy to generate 50% of the maximum possible capacity of steam generation by the boiler means 16.

Fourth conduit means 50 recycles a second portion of the high temperature flue gas stream to the control valve 64 and to the fluidizing gas stream in first conduit means 15 at a rate of 294,000 lb/hour and a temperature of 1500° F.

Sixth conduit means 54 extracts a low temperature flue gas stream from the boiler means 16 at a rate of 294,000 lb/hour and a temperature of 400° F. Seventh conduit means 56 directs a first portion of this low temperature flue gas stream to the stack 58 at a rate of 78,000 lb/hour and a temperature of 400° F. Eighth conduit means 60 recycles a second portion of the low temperature flue gas stream to the control valve 64 and to the fluidizing gas stream in first conduit means 15 at a rate of 216,000 lb/hour and a temperature of 400° F.

The fifth conduit means 52 directs a stream of combustion gas to the fluidizing gas stream in first conduit means 15 at a rate of 72,000 lb/hour and a temperature of 60° F. so as to provide sufficient air to the fluidized particulate bed 12 for combustion of the coal being charged at the previously mentioned rate of 6,000 lb/hour and 60° F.

It is noted that the flow rate of the first portion of the low temperature flue gas directed to the exhaust stack is equal to the sum of the flow rates of coal charged to the fluidized bed 12 and combustion air added to the fluidizing gas stream. Thus, by minimizing the amount of combustion air added to the fluidizing gas stream and maximizing the amount of recycled flue gas utilized in the fluidizing gas stream, the heat energy lost due to flue gas going to the exhaust stack 58 is minimized thus maximizing the efficiency of the overall system as compared to systems wherein the recycling of flue gas energy is not maximized.

When the load on the boiler means 16 is varied, the system 10 reacts in the following manner.

For example, if the load on boiler means is increased by increasing the demand for steam in steam header 22, the pressure sensing means 62 senses a decrease in pressure in steam header 22 thereby indicating an increase in load on the boiler means 16.

The control valve means 64 which is operatively associated with pressure sensing means 62 by control line means 66 then reacts to this increased demand by increasing the first portion of the high temperature flue gas stream directed to third conduit means 46 relative to the second portion of the high temperature flue gas stream flowing through fourth conduit means 50. This increases the amount of high temperature flue gas flowing through the boiler means 16 and thus provides the capability of generating additional steam so as to maintain a desired steam pressure within the steam header 22.

As can be seen by comparing the figures in Table 1 for 100% load to the figures in Table 1 for 50% load, when the first portion of the high temperature flue gas stream in conduit 46 is increased relative to the flow rate of the second portion of the high temperature flue gas stream in conduit 50, the temperature of the fluidizing gas stream in first conduit means 15 drops significantly. The flow rate of the fluidizing gas stream also drops by a relatively small amount.

The reason for this drop in temperature of the fluidizing gas stream is that a greater proportion of the energy within the high temperature flue gas stream is being extracted in the boiler means 16 and thus there is less energy left to be recycled to the fluidizing gas stream.

Because of the fact that less energy is being recycled to the fluidized particulate bed 12, it is then necessary to increase the rate at which fuel and combustion air are added to the fluidized bed 12 in order to maintain constant the temperature and flow rate of the high temperature flue gas stream in second conduit means 36.

Simultaneously, the flue gas pressure in heat exchanger means 16 is regulated by means of the pressure sensor 68 and control valve 70. As the load on the boiler means 16 is increased, the flow rate of the first portion of the low temperature flue gas stream directed to stack means 58 increases because the flow rates at which fuel and air are being added to the system have also been increased.

Also simultaneously, the flow rate of the high temperature flue gas stream within second conduit means 36 is maintained substantially constant by flow sensing means 76 and the variable speed blower 74 connected thereto by control lines 78.

In the manner just described, the fluidized bed boiler system of the present invention provides a highly efficient system which minimizes energy lost due to flue gas going to the exhaust stack. This system also is mechanically very reliable because a fixed fluidized bed is utilized thereby eliminating the complexities of recirculating solids-type systems, and at the same time no heat transfer surfaces need be placed within the fluidized particulate bed itself thus eliminating the problems encountered in conventional fixed fluidized bed systems.

Also, a system is provided whereby a rapid response can be made to variations in boiler load without affecting the operation of the fluidized bed itself. This rapid response is provided by means of the fluidized particulate bed 12 which acts as a large heat sink so as to provide a source of heat energy for quickly increasing the amount of energy being provided to the boiler means 16.

The control system described above introduces combustion air at a rate that bears a fixed ratio to the rate at which fuel is charged, i.e. excess air in the range of 10–20% is preferably provided. It is also possible, however to instead introduce the air or oxygen-containing gas so as to maintain a predetermined oxygen level in the system. This is done by measuring the oxygen content of the hot flue gas leaving the fluidized bed and based on this signal, regulating the rate at which the oxygen-containing gas or air is introduced into the system so as to maintain the oxygen contant of the flue gas leaving the fluidized bed at a constant predetermined level.

Another advantage provided by the present system, as compared to a recirculating solids system, is that flue gas has a higher specific heat than does the solid material normally used in a fluidized bed, and thus the mass flow rate of the recirculating material necessary to provide transfer of a given amount of heat energy is less with the present system than with a recirculating solids system.

Thus, it is seen that the apparatus and methods of the present invention are readily adapted to achieve the ends and advantages mentioned as well as those inherent therein. While certain perferred embodiments of the present invention have been illustrated for the purposes of the present disclosure, numerous changes in the arrangement and construction of parts and steps may be made by those skilled in the art which changes are encompassed within the scope and spirit of the present invention as defined by the appended claims.

I claim:

1. A method of operating a fluidized bed heater, said method comprising the steps of:

(a) fluidizing a particulate bed by injecting a stream of fluidizing gas into said bed;

(b) charging fuel into said fluidized particulate bed;

(c) burning said fuel in said fluidized particulate bed;

(d) extracting a high temperature flue gas stream from said fluidized particulate bed;

(e) directing to a heat exchanger means a first portion of said high temperature flue gas stream;

(f) transferring heat energy from said first portion of said high temperature flue gas stream in said heat exchanger means;

(g) recycling a second portion of said high temperature flue gas stream to said fluidizing gas stream and thus to said fluidized particulate bed;

(h) adding a stream of combustion gas to said fluidizing gas stream and thus to said fluidized particulate bed;

(i) directing a first portion of a low temperature flue gas stream exiting said heat exchanger means to an exhaust stack; and (j) recycling a second portion of said low temperature flue gas stream to said fluidizing gas stream and thus to said fluidized particulate bed.

2. The method of claim 1, further comprising:

sensing a variation in load at said heat exchanger means;

varying, in response to said sensing of said variation of load, said first portion of said high temperature flue gas stream relative to said second portion of said high temperature flue gas stream, and thereby causing a resulting variation in temperature of said fluidizing gas stream injected into said fluidized particulate bed;

sensing a variation of a temperature of said high temperature flue gas stream resulting from said variation in temperature of said fluidizing gas stream injected into said fluidized particulate bed; and varying, in response to said sensing of a variation of temperature of said high temperature flue gas stream, a rate at which fuel is charged to said fluidized particulate bed and a rate at which combustion gas is added to said fluidizing gas stream, and thereby maintaining said temperature of said high temperature flue gas stream substantially constant.

3. The method of claim 2, wherein:

said variation in load at said heat exchanger means is an increase in load;

said first portion of said high temperature flue gas stream is increased relative to said second portion of said high temperature flue gas stream;

said variation of temperature of said high temperature flue gas stream is a decrease in temperature; and said rate at which fuel is charged to said fluidized particulate bed and said rate at which combustion gas is added to said fluidizing gas stream are increased.

4. The method of claim 2, wherein:

said variation in load at said heat exchanger means is a decrease in load;

said first portion of said high temperature flue gas stream is decreased relative to said second portion of said high temperature flue gas stream;

said variation of temperature of said high temperature flue gas stream is an increase in temperature; and said rate at which fuel is charged to said fluidized particulate bed and said rate at which combustion gas is added to said fluidizing gas stream are decreased.

5. The method of claim 2, wherein:

a ratio of said rate at which said combustion gas is added to said fluidizing gas stream compared to said rate at which fuel is charged to said fluidized particulate bed is such that approximately 10 to 20% excess combustion gas is provided for combustion of said fuel.

6. The method of claims 1 or 2, wherein:

said second portion of said high temperature flue gas stream is recycled directly to said fluidizing gas stream and thus to said fluidized particulate bed without any substantial heat transfer therefrom other than to said recycled second portion of said low temperature flue gas stream and to said combustion gas stream.

7. The method of claims 1 or 2, further comprising:

sensing a pressure of said low temperature flue gas stream; and varying, in response to said sensing of the pressure of said low temperature flue gas stream, a flow rate of said first portion of said low temperature flue gas stream, and thereby regulating a flue gas pressure in said heat exchanger means.

8. The method of claims 1 or 2, further comprising:
sensing a flow rate of said high temperature flue gas stream; and
controlling, in response to said sensing of said flow rate of said high temperature flue gas stream, a flow rate of said fluidizing gas stream and thereby maintaining said flow rate of said high temperature flue gas stream substantially constant.

9. The method of claim 1, said heat exchanger means being a boiler means, wherein:
said step (f) is further characterized as generating steam in said boiler means by transferring said heat energy from said first portion of said high temperature flue gas stream to a feedwater stream; and
said method further includes a step of directing said steam from said boiler means to a steam header.

10. The method of claim 9, further comprising:
sensing a variation in demand for steam at said steam header;
varying, in response to said sensing of said variation of demand, said first portion of said high temperature flue gas stream relative to said second portion of said high temperature flue gas stream, and thereby causing a resulting variation in temperature of said fluidizing gas stream injected into said fluidized particulate bed;
sensing a variation of a temperature of said high temperature flue gas stream resulting from said variation in temperature of said fluidizing gas stream injected into said fluidized particulate bed; and
varying, in response to said sensing of a variation of temperature of said high temperature flue gas stream, a rate at which fuel is charged to said fluidized particulate bed and a rate at which combustion gas is added to said fluidizing gas stream, and thereby maintaining said temperature of said high temperature flue gas stream substantially constant.

11. The method of claim 10, wherein:
said step of sensing a variation of demand for steam at said steam header is further characterized as sensing a variation in pressure of said steam in said steam header. j 12. A fluidized bed heater system comprising:
a fluidized particulate bed;
first conduit means for injecting a stream of fluidizing gas into said fluidized particulate bed;
charge means for charging fuel into said fluidized particulate bed;
second conduit means for extracting a high temperature flue gas stream from said fluidized particulate bed;
heat transfer means for transferring heat energy from said high temperature flue gas stream;
third conduit means for directing a first portion of said high temperature flue gas stream from said second conduit means to said heat transfer means;
fourth conduit means for recycling a second portion of said high temperature flue gas stream from said second conduit means to said first conduit means;
fifth conduit means for directing a stream of combustion gas to said first conduit means;
sixth conduit means for extracting a low temperature flue gas steam from said heat transfer means;
seventh conduit means for directing a first portion of said low temperature flue gas stream from said sixth conduit means to an exhaust stack; and
eighth conduit means for recycling a second portion of said low temperature flue gas stream from said sixth conduit means to said first conduit means.

13. The system of claim 12, further comprising:
first sensing means, operatively associated with said heat exchanger means, for sensing a variation in load on said heat exchanger means;
first control means, operatively associated with said first sensing means, for varying said first portion of said high temperature flue gas stream relative to said second portion of said high temperature flue gas stream;
temperature sensing means for sensing a variation of a temperature of said high temperature flue gas stream; and
second and third control means, both operatively associated with said temperature sensing means, for varying a rate at which said charge means charges fuel into said fluidized particulate bed, and for varying a rate at which combustion gas is directed to said first conduit means, and for thereby maintaining substantially constant said temperature of said high temperature flue gas stream.

14. The system of claim 13, wherein:
said first control means is a three-way control valve connected to said first, fourth and eighth conduit means.

15. The system of claims 12, 13 or 14, wherein:
said fourth conduit means is connected directly between said second conduit means and said first conduit means.

16. The system of claims 12 or 13, further comprising:
pressure sensing means for sensing a pressure of said low pressure flue gas stream in said sixth conduit means; and
control valve means, disposed in said seventh conduit means and operatively associated with said pressure sensing means for varying a flow rate of said first portion of said low temperature flue gas stream and for thereby regulating a flue gas pressure in said heat exchanger means.

17. The system of claims 12 or 13, further comprising:
flow sensing means for sensing a flow rate of said high temperature flue gas stream in said second conduit means; and
variable speed blower means, disposed in said first conduit means and operatively associated with said flow sensing means, for varying a flow rate of said fluidizing gas stream in said first conduit means in response to said flow rate of said high temperature flue gas stream in said second conduit means and for thereby maintaining said flow rate of said high temperature flue gas stream substantially constant.

18. The system of claim 12, wherein:
said heat transfer means is further characterized as a boiler means for transferring said heat energy from said high temperature flue gas stream to feedwater to generate steam from said feedwater; and
said system further includes a steam header for receiving said steam from said boiler means.

19. The system of claim 18, further comprising:
first sensing means, operatively associated with said steam header, for sensing a variation in demand for steam at said steam header;
first control means, operatively associated with said first sensing means, for varying said first portion of said high temperature flue gas stream relative to said second portion of said high temperature flue gas stream;

temperature sensing means for sensing a variation of a temperature of said high temperature flue gas stream;

second and third control means, both operatively associated with said temperature sensing means, for varying a rate at which said charge means charges fuel into said fluizied particulate bed, and for varying a rate at which combustion gas is directed to said first conduit means, and for thereby maintaining substantially constant said temperature of said high temperature flue gas stream.

20. The system of claim 19, wherein:

said first sensing means is a means for sensing a pressure of steam in said steam header.

* * * * *